US007207077B2

(12) United States Patent
Hicks

(10) Patent No.: US 7,207,077 B2
(45) Date of Patent: Apr. 24, 2007

(54) BACKPACKERS/MOUNTAINEERS COT

(76) Inventor: Brian Emmett Hicks, 649 NW. 13th St., McMinnville, OR (US) 97128

( * ) Notice: Subject to any disclaimer, the term of this patent is extended or adjusted under 35 U.S.C. 154(b) by 231 days.

(21) Appl. No.: 10/796,538

(22) Filed: Mar. 8, 2004

(65) Prior Publication Data

US 2006/0026757 A1 Feb. 9, 2006

(51) Int. Cl.
*A47C 17/00* (2006.01)
*A45F 4/06* (2006.01)

(52) U.S. Cl. ..... 5/110; 5/114; 224/156; 224/634

(58) Field of Classification Search ..... 5/110, 5/111, 114; 224/156, 153, 634, 633
See application file for complete search history.

(56) References Cited

U.S. PATENT DOCUMENTS 46,195 A * 1/1865 Weber ..... 224/154
1,541,060 A * 6/1925 Martin ..... 224/156
2,964,222 A * 12/1960 Rainwater ..... 224/156
4,511,071 A * 4/1985 Curran ..... 224/156
4,947,498 A * 8/1990 Van Boxtel ..... 5/113
5,265,289 A * 11/1993 Swiger et al. ..... 5/111
5,590,825 A 1/1997 Murdock
6,202,907 B1 * 3/2001 Higgins ..... 224/156
6,651,853 B2 * 11/2003 Higgins et al. ..... 224/155

* cited by examiner

*Primary Examiner*—Patricia Engle
*Assistant Examiner*—Gilbert Lee

(57) ABSTRACT

A backpacker/mountaineers cot that is lightweight enough to be carried in the backcountry and that is assembled using a minimal of structural cot components in conjunction with various commonly used mountaineer's tools. It allows the elimination of the piece of foam or the inflatable sleeping pad that mountaineers generally backpack. Instead, the mountaineer incorporates his trekking poles, ice ax and internal frame backpack stays with the cot's structural components to form a lightweight, strong or the appropriate assembly of the cot.

1 Claim, 7 Drawing Sheets

BACKPACKERS/MOUNTAINEERS COT

BACKGROUND OF THE INVENTION

This invention relates to a sleeping cot, lightweight enough to be used by backpackers and mountaineers in lieu of the more commonly used therma-rest (inflatable pad) or the ridge rest (foam pad).

The mountaineers' cot will be a great addition to anyone's backcountry experience. With the relative little difference in weight to be carried, the backpacker could greatly increase his/her comfort regardless of ground conditions. By using tools already being used for other purposes' the user is reducing overall weight while greatly increasing comfort. The tools already in use are as follows: Telescoping ski poles, ice ax, sleeping pad, sleeping pad camp chair and internal frame backpack. The cot user will exchange the sleeping pad and chair for the cot fabric and six cot legs. By adapting the internal frame backpacking stays into the side-rails of the cot and using the trekking poles and ice ax as the end and center stays of the cot the user will have the ultimate in efficiency and comfort in the backcountry environment.

Currently in the sports of backpacking and mountaineering, the only lightweight sleeping pads are the therma-rest and the ridge rest. These sleeping pads, although relatively comfortable, have some significant disadvantages. For example: a therma-rest, while providing comfort and insulation, can fail if the barrier is breached causing an air leak and leaving the user in the position of sleeping on cold, icy, rocky, uncomfortable ground. The ridge rest being the lighter of the two is less comfortable and provides less insulation.

Prior art has discussed the use of a backpack cot, i.e. U.S. Pat. No. 5,590,825, where the cot is incorporated into the external frame backpack. The disadvantages of this idea are that you are basically doubling the weight of your backpack. In addition, you are removing the storage capability of your pack for camping. You would have to displace the entire contents of your pack in order to deploy your cot. Furthermore, the external frame required for this patent has greatly decreased in popularity over the last two decades for many reasons and current users of the external frame pack are not the target markets of this invention.

SUMMARY OF THE INVENTION

The Mountaineers Cot will provide a lightweight, comfortable and firm flat sleeping surface regardless of the ground conditions. The cot incorporates tools already in use by the backpacker and mountaineer and therefore will have little effect on increasing the weight to be carried. Currently, many avid backpackers and mountaineers employ the use of telescoping ski poles or trekking poles, an ice ax if the terrain demands it and an internal frame pack. By incorporating all option levels of the Mountaineers cot, you would be carrying the cot cloth and six 6 inch legs. The trekking poles become the end stays of your cot. The ice ax is your center stay and the side rails come from the main stays of your internal frame pack. In addition, several different brands of internal frame packs use a relatively similar main stay system, a conversion from existing mainstay design to a mainstay that can act as the siderails of the cot can be manufactured to retrofit an individuals current pack allowing the owner to keep his/her original pack. The conversion will match up the metal stay ends of the existing pack requirements with telescoping siderails of the cot. The retrofit will then be made with varying sizes. The adjustable side rails and conversion could thus replace the existing mainstays. This full use of existing tools is called option 1.

When option 1 is not what the owner is interested in because he/she is happy with their current pack or the owner cannot afford the new pack, an individual can use option 2. Option 2 requires the user to carry the side rails in addition to the cloth and the six 6 inch legs. The increase in weight would be relative to a backpacker adding a sleeping pad chair to his/her pack. Special note: the sleeping pad chair is a popular option for backpacker that uses four independent poles stretched over by nylon with pockets on each end to stuff the foam sleeping pad or inflatable sleeping pad. Then the user uses straps to cinch the chair into a sitting position. Option 2 would only require the use of the ski poles and the ice ax. I will also note at this time that the mountaineers' cot will incorporate the use of four independent side rails and adjustable side straps so the user can use the cot as a camp chair similar to the sleeping pad chair.

Option 3 is simply the backpacker option. When using option 3, the only dual use incorporated is the use of the ski poles as the end stays. A standard center stay (ice ax extender) is used in lieu of the ice ax. Of course, the user could also elect to use the option 4 backpack, without the ice ax and still be lightweight. The center stay will be the ice ax extender used to extend the length of shorter ice axes in order for the ice ax to fit to the cot as a center stay. The ice ax extender will come in a length that is fitted to the size of the center cot main stay but can be cut down by the user if he/she decides to use the ice ax center stay option.

Option 4 is simply an ultra light cot. It is not as light as a sleeping pad, but a perfect option for the packer looking for comfort. Option 4 could have a secondary target market in the hunter who is looking for the ultra light comfort, but with no need for the other options.

In addition, various cot cloths should be included in the options: a lighter weight mesh for warmer environments, an insulated cot for cold weather and a standard nylon single layer cloth for normal conditions.

DETAILED DESCRIPTION OF THE DRAWINGS

Figure 1:
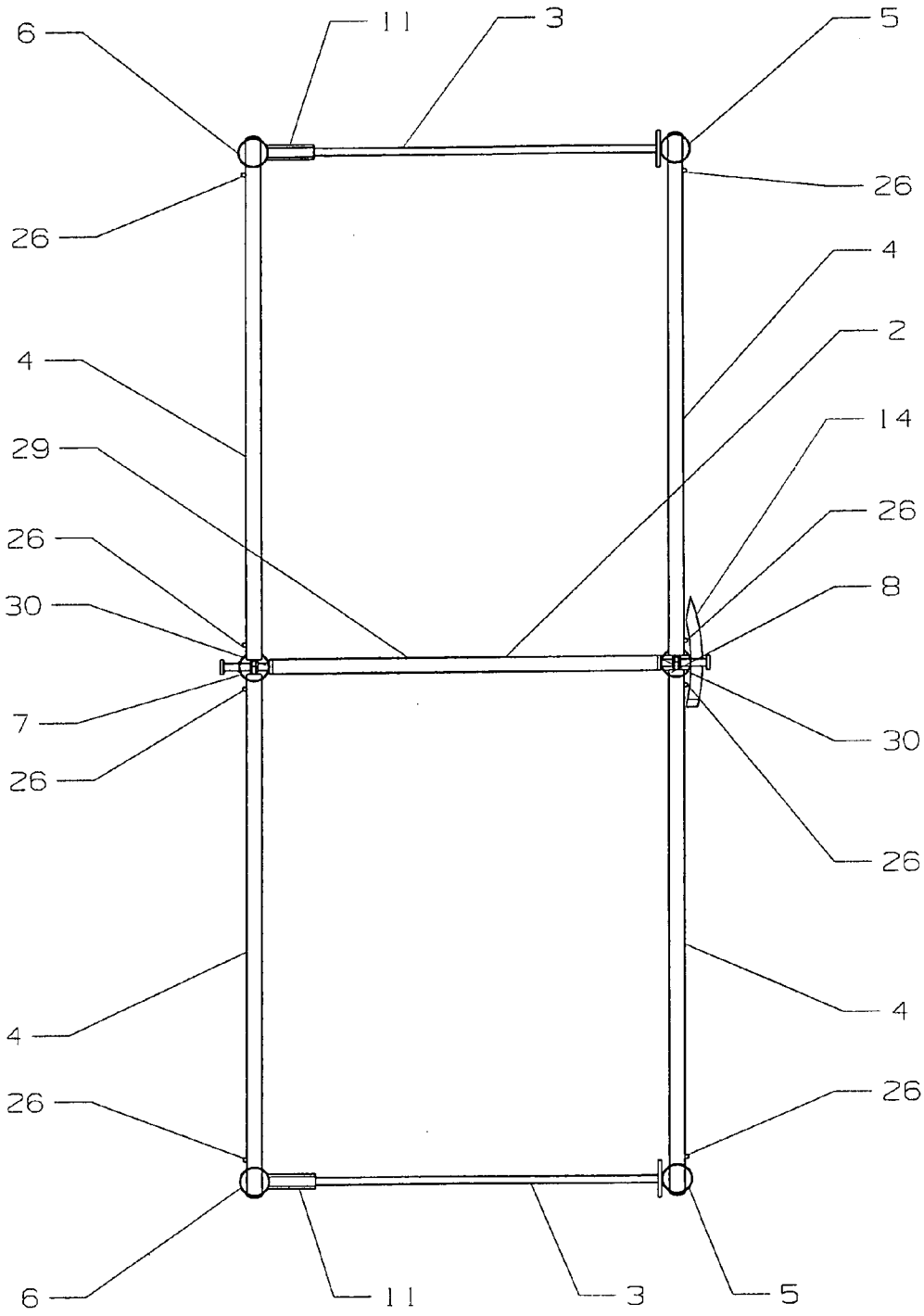
FIG. 1 is an overhead view of the cot and its parts assembled for use.
Figure 2:
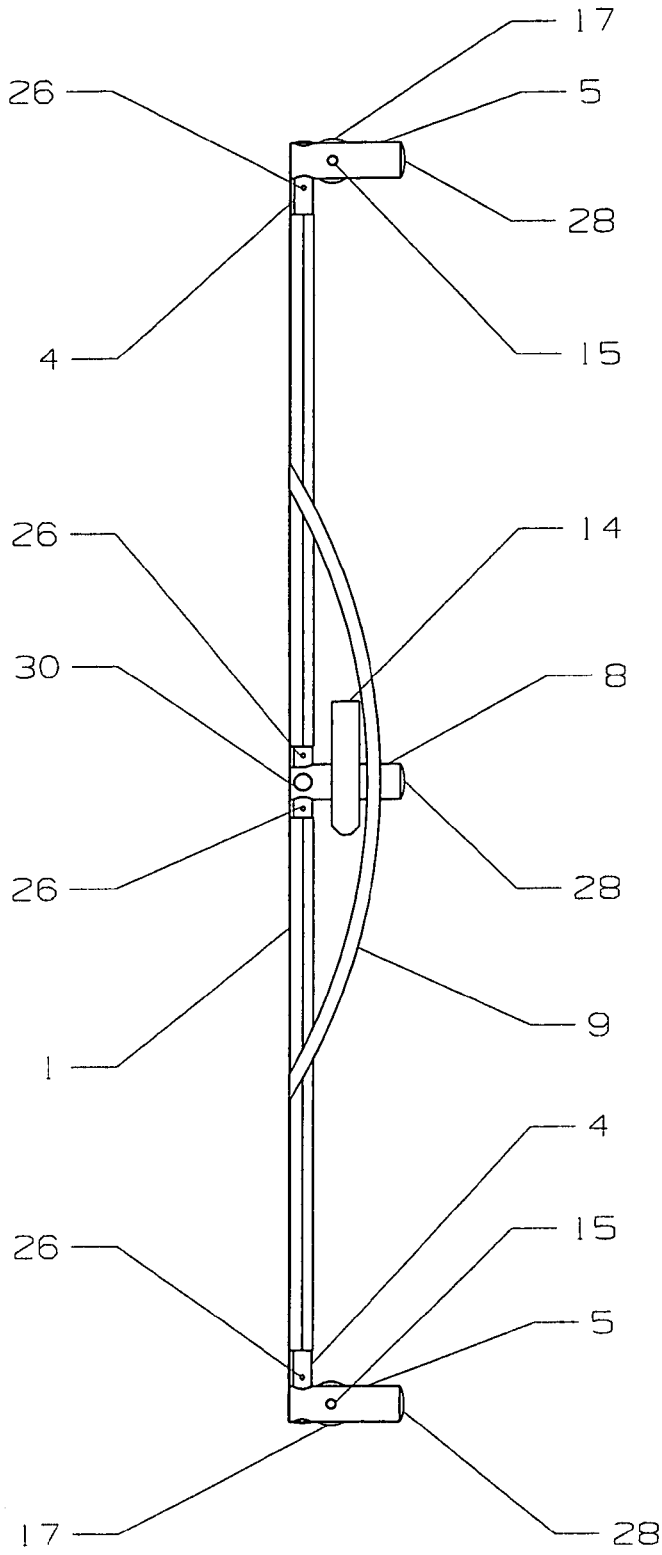
FIG. 2 is a side view of the cot and its parts assembled for use.

FIG. 1 is an overall look at the cot when it is assembled and the position of all of the related material necessary to have the cot assembled. FIG. 1 is an above view of the cot. The cot fabric 1 is standard cut length and width of existing cots with sleeves down the length and width of the cot to hold the side-rails 4 and the telescoping ski poles 3. There are four side-rails 4 for the cot, each approximately ½ the length of the cot. The side-rails 4 will be made to telescope in order to facilitate easier packing or adjust to the use as a main stay of internal frame packs. At each end of the cot are the telescoping ski poles 3. These telescoping ski poles 3, (referred to as trekking poles hereafter) are on the market today and have a telescoping feature that would allow them to be used as the end stays of the cot. By reducing the trekking pole 3 to the proper length, inserting them into the end legs and then tensioning the trekking pole 3 the proper fit could be found. The center stay is made from the ice ax 2. The position of the ice ax 2 on the center legs will be lower down so as not to interrupt the sleeping surface of the cot as shown in FIG. 2 by the position of the ax head 14 in relation to the cot. In addition, an incline strap 9 will be sewn into the cot in order for the user to raise the cot into a camp chair position for uses other than sleep. The center leg will have a free floating bolt 30 in order for this to occur. The detail of the legs that receive the ice ax 2, trekking poles 3 and side-rails 4 are detailed in FIGS. 3 through 10.

Figure 3:
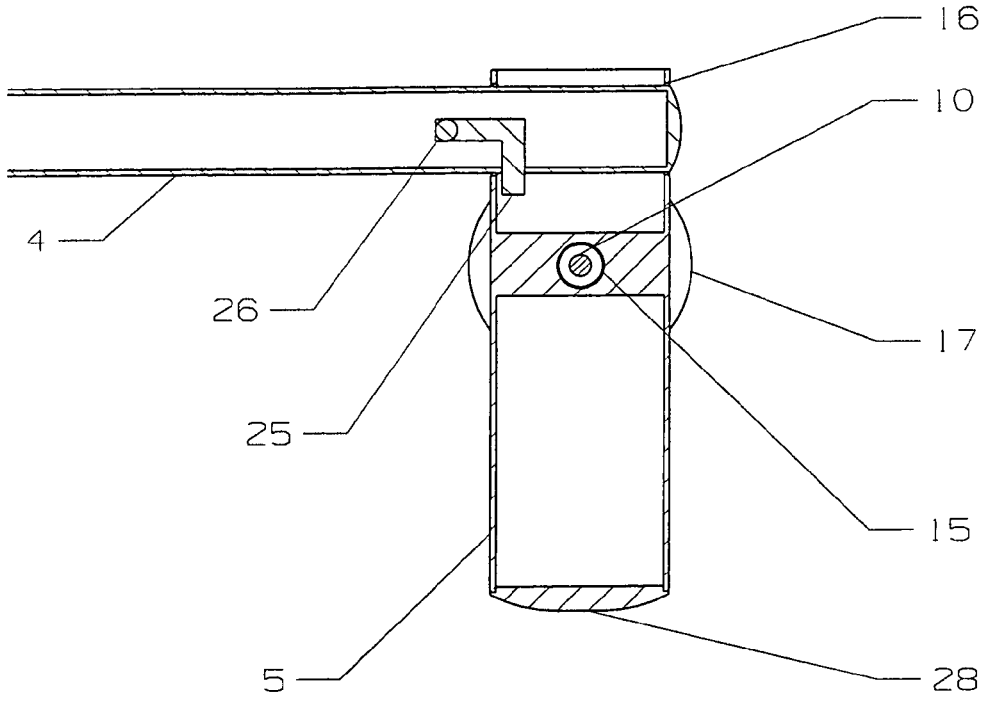
FIG. 3 is a side view of a pole tip leg with a side-rail inserted in position.
Figure 4:
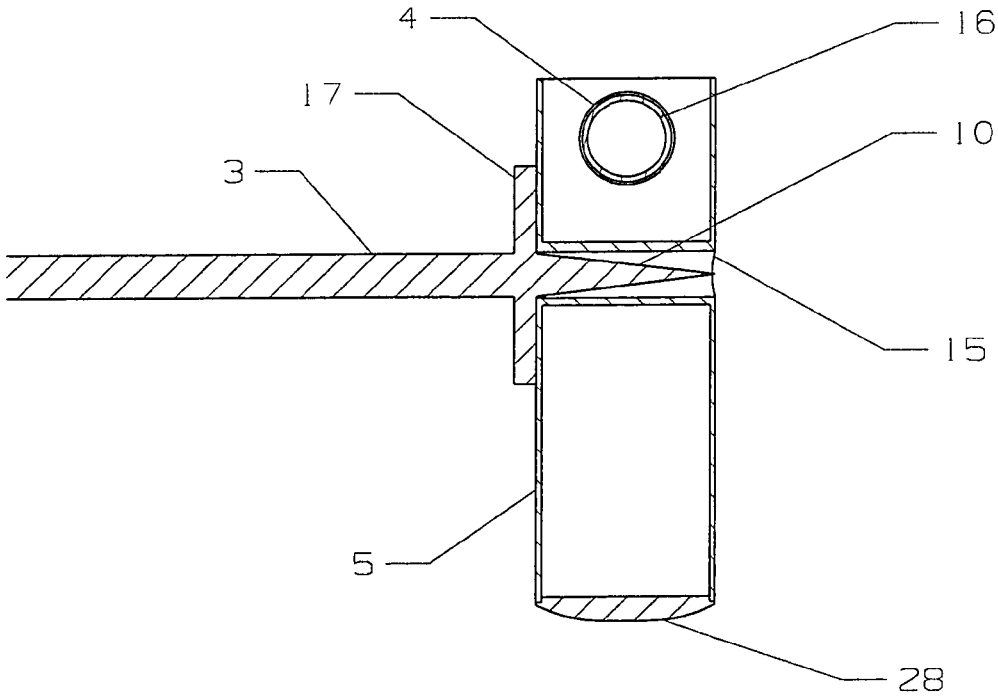
FIG. 4 is a front view of a pole tip leg with a pole tip inserted in position.

FIGS. 3 and 4 refer to the pole tip legs 5 that receive the trekking pole tip 10. There is a side view, FIG. 3 which shows approximate location of the pole tip receiver hole 15 on the pole tip legs. There will be two pole tip legs 5, one for each trekking pole 3. FIG. 3 shows how the side-rail 4 is received by the pole tip leg 5 and where the side-rail lock 25 and side-rail lock button 26 are located. Also noted in FIG. 3 is the rubber boot 28 added to the end of each leg in order to reduce damage to the cot leg and the tent floor of the user. FIG. 4 is the same leg as FIG. 3 only rotated 90 degrees to show how the pole tip 10 is received into the pole tip leg 5. The pole basket 17 will stop the advance of the trekking pole 3 through the leg beyond the pole tip 10. There is no locking mechanism for the pole tip 10 because the trekking pole 3 will be tensioned after insertion into the legs by its existing telescoping feature.

Figure 5:
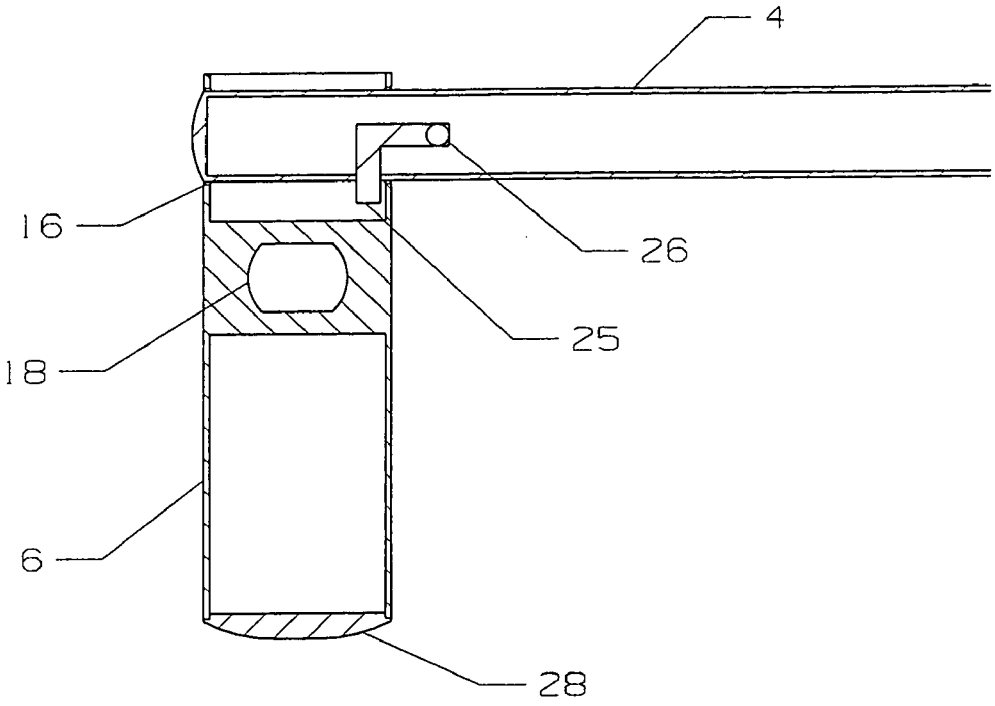
FIG. 5 is a side view of a pole handle leg with side-rail inserted in position.
Figure 6:
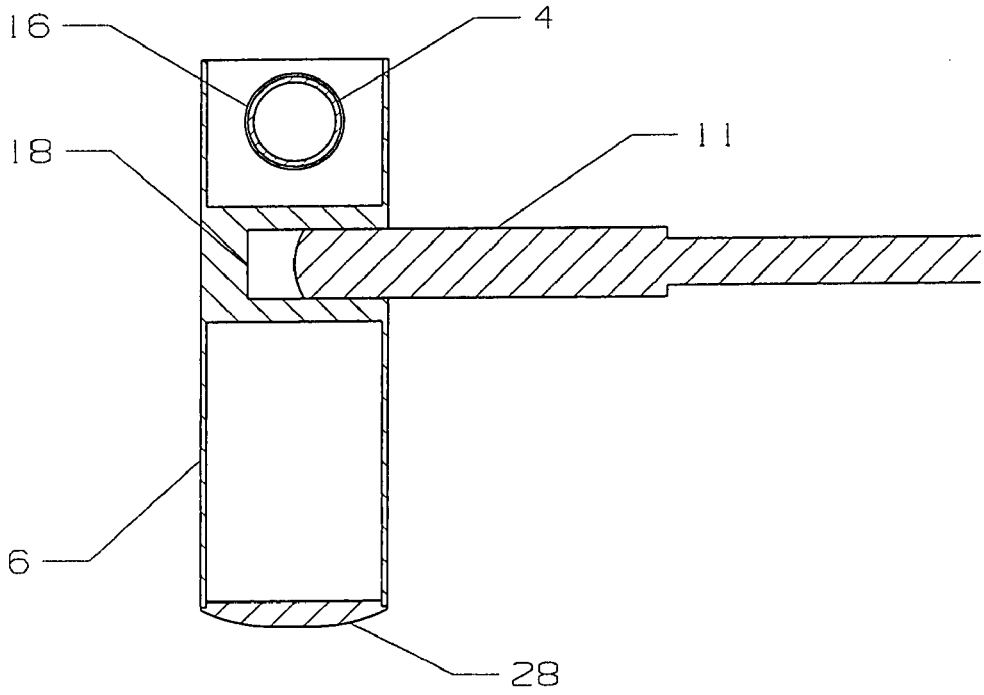
FIG. 6 is a front view of a pole handle leg with a pole handle inserted in position.

FIG. 5 refers to the pole handle legs 6 that receive the pole handle 11 end of the trekking pole 3 and its location in regards to the side-rail receiver hole 16, side-rail 4 and shows the side-rail lock 25 and side-rail lock button 26 location. There will be two of these legs, one for each trekking pole 3. FIG. 6 is the same as FIG. 5 only rotated 90 degrees to show how the pole handle 11 is received into the pole handle leg 6 and its location in regard to the side rail receiver hole 16.

Figure 7:
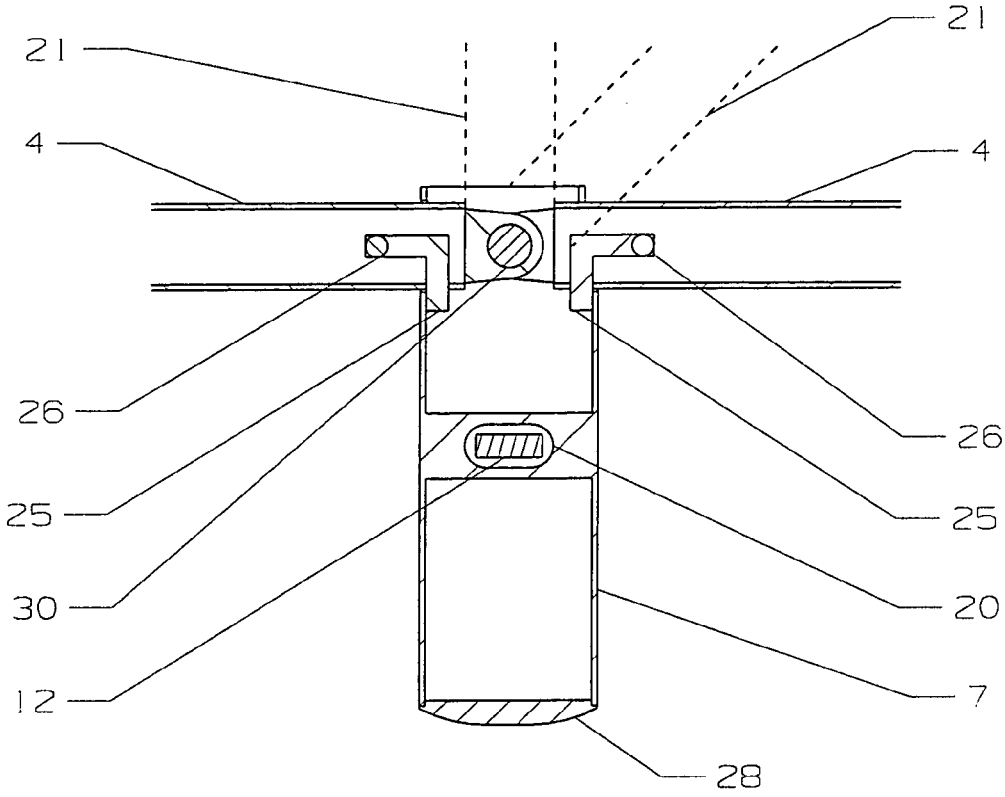
FIG. 7 is a side view of an ax point leg with side-rails inserted in position.
Figure 8:
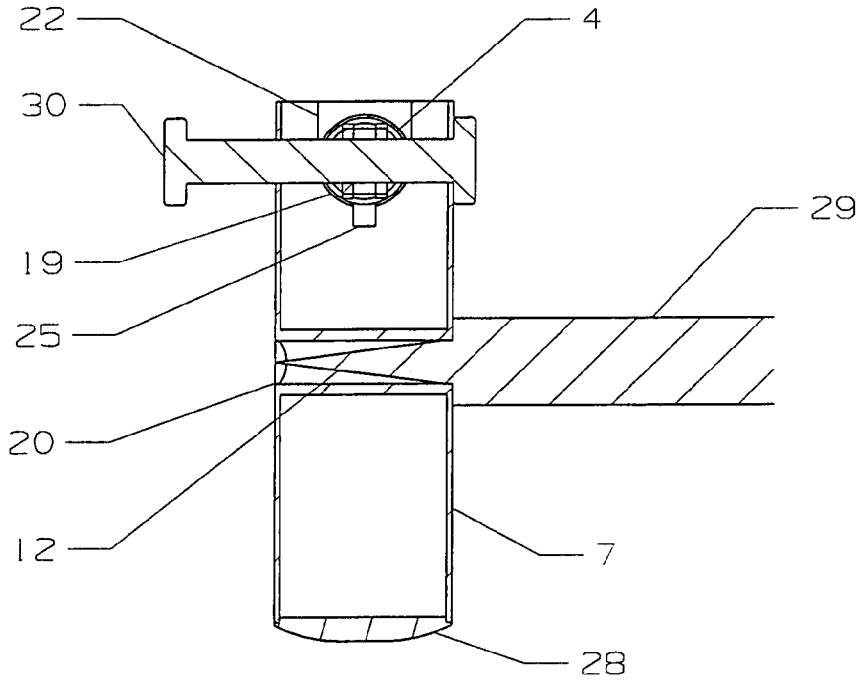
FIG. 8 is a front view of an ax point leg with the point on the ax inserted in position.

FIG. 7 refer to the ax point leg 7 of the cot. There will be one type of this center leg. FIG. 7 refers to the ax point leg 7 that receives the ax point 12. In FIG. 7, the location of the ax point receiver hole 20 is below the side-rail receiver hole 16. This is needed because the ice ax 2, if positioned above the side-rail 4, would interfere with the sleeping surface of the cot. In addition, the upper portion of the center legs is reserved for the swivel motion of the cot incline feature. The FIG. 7 shows the dotted lines to suggest the various positions of the side-rail 4 as it is adjusted with the incline strap 9. In addition, FIG. 7 shows a free floating bolt 30 that attaches to each end of the side rail center receiver hole 19 that allows for incline adjustment of the cot. The side-rail lock button 26 and lock 25 are again shown. FIG. 8 is the same as FIG. 7 except turned 90 degrees to show how the ax point 12 is received in relation to the other components of the ax point leg 7. The nature of an ax point 12, which tapers out to the ax shaft 29, will allow the ax point leg to not require a locking mechanism.

Figure 9:
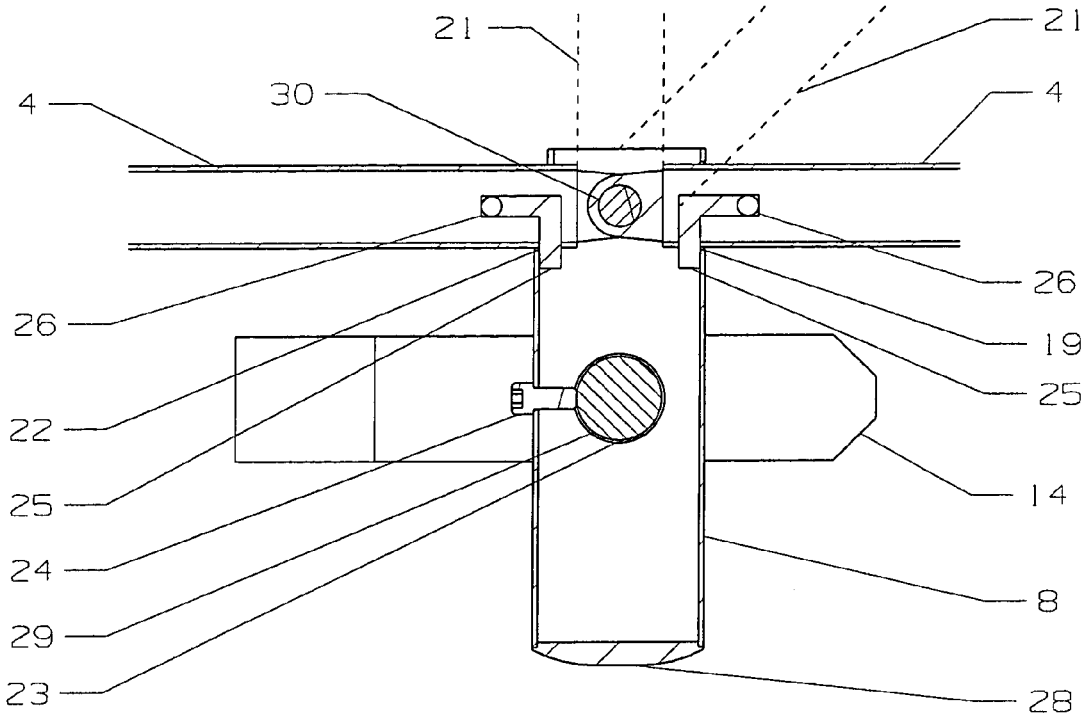
FIG. 9 is a side view of an ax head leg with the shaft of the ice ax inserted in position.
Figure 10:
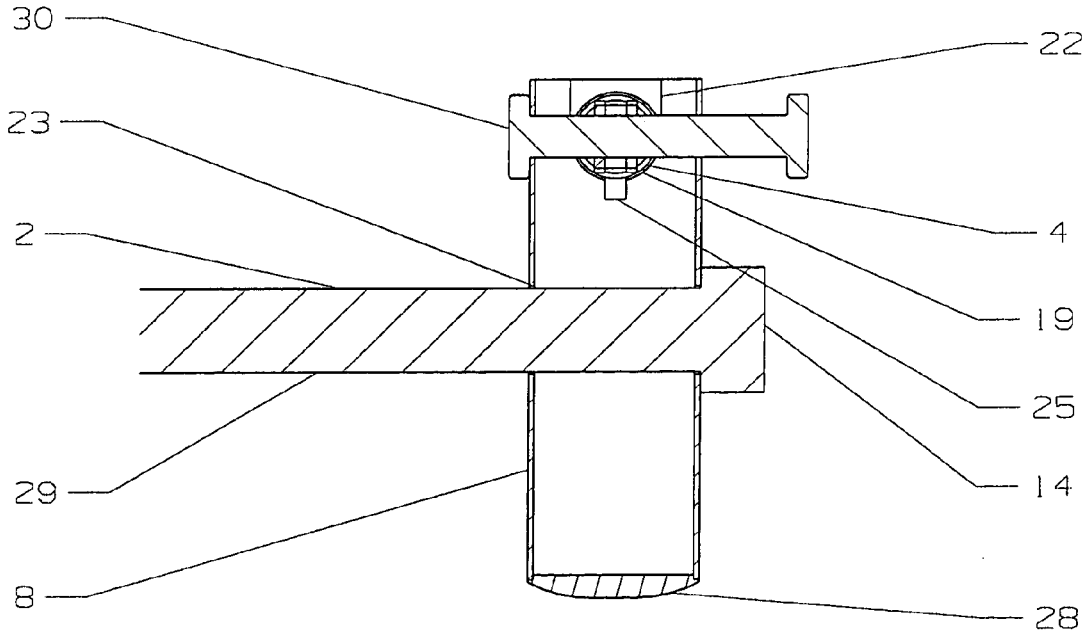
FIG. 10 is the front view of an ax head leg with the shaft of the ice ax inserted in position.

FIG. 9 refers to the details of the ax head leg 8, which receives the ax shaft 29. There is only one of these type legs. The ax receiver hole 23 shows the approximate size of the hole and the ax screw 24, which would clamp down onto the ax shaft 29 after it has been properly tensioned onto the cot. Various side-rail positions 21 are also indicated by the dotted lines. FIG. 10 is the same as FIG. 9 except turned 90 degrees to show the side-rail center receiver hole 19 and the side-rail spacing 22 in relative position to the ax shaft 29 and to the ax head leg 8.

Figure 11:
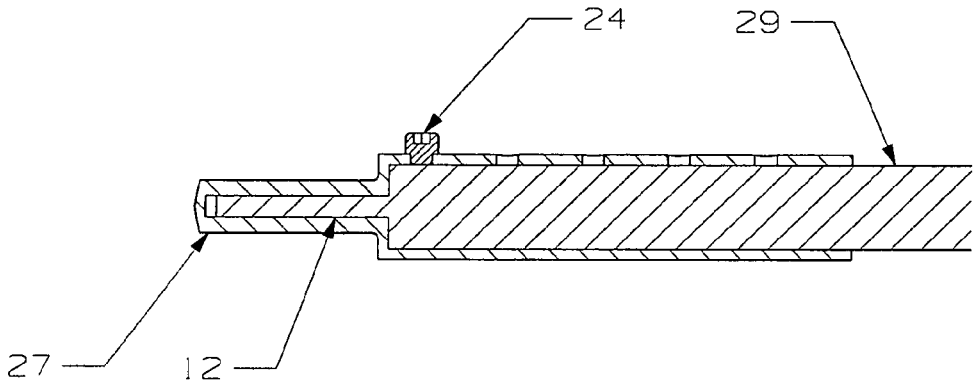
FIG. 11 is an overhead view of the ice ax extender.

FIG. 11 refer to the ice ax extender 27. Ice axes come in various lengths depending on its intended use and the height of its user. Therefore, it may be required to make an ice ax extender 27. This ice ax extender 27 would fit onto the point end of the ice ax 2, extending its length. The ice ax extender 27 will be wider at the top in order to fit over an ice ax 2. This wider portion is called an extender sleeve 31. It then narrows to an extender shaft 32 which resembles the standard size of an ax shaft 29 with an extender point 33 on the end which resembles an ice ax point 12. The extender sleeve 31 is the area where the user will size the ice ax 2 to the ice ax extender 27 and the cot and make the appropriate cut to fit on the ice ax 2. There are securing screw holes 34 on the extender sleeve 31 to hold the ice ax extender 27 in place on the ice ax 2. The ice ax extender 27 will come in a standard length which after being sized by its owner, will be cut down in order to save weight. This ice ax extender 27 will come in a standard length that will serve as the center stay of the cot if the ice ax 2 is not going to be used as a center stay by the user.

SUMMARY LIST OF ELEMENTS

Needed for operations are the following:

1. Six ft. by 2½ ft. nylon cot fabric 1 with incline strap 9.
2. Two pole tip receiver legs 5.
3. Two pole handle receiver legs 6.
4. One ax point receiver leg 7.
5. One ax head receiver leg 8.
6. Four telescoping side-rails 4. (Adapted from internal frame backpack stays).
7. Ice ax 2.
8. Ice ax extender 27. (center stay)
9. Two telescoping ski poles 3 (trekking poles).

DETAILED LIST OF ELEMENTS

1. Cot cloth
2. Ice ax
3. Telescoping ski pole (trekking pole)
4. Side-rails
5. Pole tip legs
6. Pole handle legs
7. Ax point legs
8. Ax head legs
9. Incline strap
10. Pole tip
11. Pole handle 12. Ax point
14. Ax head
15. Pole tip receiving hole
16. Side-rail receiver hole
17. Pole basket
18. Pole handle receiver
19. Side-rail center receiver hole
20. Ax point receiver hole
21. Various side-rail positions
22. Side-rail spacing
23. Ax shaft receiver hole
24. Ax screw
25. Side-rail lock
26. Side-rail lock button
27. Ice ax extender
28. Rubber boot
29. Ax shaft
30. Free floating bolt
31. Extender sleeve
32. Extender shaft
33. Extender point
34. Extender securing holes

I claim:

1. A mountaineer's cot comprising:

a fabric with side and end sleeves, at least two inclination straps to facilitate the adjustment of the cot from sleep to sitting position, six cot legs; wherein two center cot legs comprising swivel bolts for inclination of the cot are adapted to receive an ice ax, wherein one center cot leg is adapted to receive a point of the ice ax and the other center cot leg is adapted to receive a shaft of the ice ax to form a center stay of the cot; wherein four cot end legs are adapted to receive trekking poles; wherein two cot end legs are adapted to receive handles of the trekking poles and the other two cot end legs are adapted to receive tips of the trekking poles to form the end stays of the cot where the trekking poles are inserted into the end sleeves; and internal frame backpack stays modified to form side-rails for insertion into the side sleeves and locked to the four cot end legs to complete the formation of the cot.

* * * * *